US006308376B1

(12) United States Patent
Koshikawa

(10) Patent No.: US 6,308,376 B1
(45) Date of Patent: Oct. 30, 2001

(54) HINGE WITH A SAFETY SHIELD PLATE UNIT

(75) Inventor: Shinichirou Koshikawa, Tokyo (JP)

(73) Assignee: Sugatsune Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/408,144

(22) Filed: Sep. 29, 1999

(30) Foreign Application Priority Data

Sep. 29, 1998 (JP) ..... 10-274523

(51) Int. Cl.[7] ..... E05D 11/00; E05D 15/32
(52) U.S. Cl. ..... 16/250; 16/366; 16/370
(58) Field of Search ..... 16/250, 366, 368, 16/369, 370

(56) References Cited

U.S. PATENT DOCUMENTS 4,914,782 * 4/1990 Rupprechter ..... 16/319
5,058,238 * 10/1991 Lautenschlager ..... 16/278
5,062,182 * 11/1991 Griffiths et al. ..... 16/368
5,450,655 * 9/1995 Ferrari et al. ..... 16/370
5,791,016 * 8/1998 Lenz ..... 16/258
5,966,777 * 10/1999 Jantschek ..... 16/354

* cited by examiner

*Primary Examiner*—Chuck Y. Mah
(74) *Attorney, Agent, or Firm*—Jacobson Holman, PLLC

(57) ABSTRACT

A hinge with a safety shield plate unit is designed not to cover the hinge but to be rotatably fitted to the fixed front shaft of the hinge and be resiliently urged toward the cup-shaped fixing member of the hinge by a resilient member in such a way that the safety shield plate unit is prevented from unnecessarily moving toward the cup-shaped fixing member by causing the anchoring sections of the movable link arm to abut the respective anchored sections of the safety shield plate unit. The hinge main body includes a fixing member fitted to a fixed plate and a cup-shaped fixing member fitted to a movable plate. The members are linked together by movable arms. A safety shield plate unit fitted to the fixed front shaft linking the fixing member and the movable link arm is urged downward to follow and hide the hazardous area defined by the movable arms and the cup-shaped fixing member and having a volume that increases with the opening movement of the movable plate. The anchored sections of the safety shield plate unit are held by the respective anchoring sections to prevent the safety shield plate unit from inadvertently falling into the cup-shaped space and blocking the opening movement of the hinge.

8 Claims, 9 Drawing Sheets

HINGE WITH A SAFETY SHIELD PLATE UNIT

BACKGROUND OF THE INVENTION

1. Field of the Invention

This invention relates to a hinge to be used to allow a furniture door to swing open and closed. More particularly, it relates to a hinge comprising a plurality of movable arms and a safety shield plate unit adapted to prevent part of the clothes or a finger of the user that is inadvertently put into the hazardous space with a variable volume defined by the moving arms of the hinge from being damaged or, in the worst case, cut by the moving arms.

2. Prior Art

There are known hinges designed to prevent part of the clothes or a finger of the user that is inadvertently put into the hazardous space with a variable volume defined by the moving arms of the hinge from being damaged.

FIGS. 14 through 16 of the accompanying drawings schematically illustrate a known hinge of the type under consideration (Japanese Utility Model Publication No. 5-2287). It comprises a fixing member 1 to be rigidly fitted to the inside surface of an anchor plate A, which may be a lateral plate of the main body of a piece of furniture, a cup-shaped fixing member 2 to be rigidly fitted to the inner surface of a movable plate B, which may be the door of the piece of furniture, and engaged with the fixing member 1 and four movable arms including a movable link arm 3, a movable rear arm 4, an movable intermediary arm 5 and a movable front arm 6.

The movable link arm 3 and the movable rear arm 4 are arranged respectively to pivot on a fixed front shaft 1*a* and a fixed rear shaft 1*b* and the movable rear arm 4 pivots on an intermediary rear shaft 5*b* arranged at the (intermediary) rear end 5*a* of the movable intermediary arm 5.

Additionally, said movable intermediary arm 5 pivots at the (intermediary) front end 5*c* thereof on an intermediary cup-side shaft 5*d* located inside the cup-shaped space 2*a* of said cup-shaped fixing member 2 and hence close to said fixing member 1 so that said movable link arm 3 and the movable intermediary arm 5 are linked together at respective middle parts thereof by means of an intermediary shaft 3*e*.

Furthermore, linking front shaft 3*b* at the (linking) front end 3*a* of said movable link arm 3 and cup-side shaft 6*a* located near the outside in said cup-shaped space 2*a* of said cup-shaped fixing member 2 are linked together by the movable front shaft 6.

With the above described arrangement, the movable plate B is fitted to the fixed plate A and apt to swing open by 90 to 180 degrees relative to the furniture main body and then closed as seen from FIGS. 14, 15 and 16.

Thus, with a hinge having a configuration as described above, no space is produced by the fixed plate 1, the cup-shaped fixing member 2, the movable link arm 3, the movable rear arm 4, the movable intermediary arm 5 and the movable front arm 6 when the movable plate B is closed as shown in FIG. 14. However, there will be produced not only space S1 defined by the fixing member 1, the movable rear arm 4, the movable intermediary arm 5 and the movable link arm 3 and but also relatively large hazardous space S2 defined by the cup-shaped fixing member 2, the movable intermediary arm 5, the movable link arm 3 and the Movable front arm 6 as the movable plate B is moved to its open position along arrow OP in FIG. 15.

Then, as pointed out above, part of the clothes or a finger of the user can be inadvertently put into the space S1 and/or the hazardous space S1 having a variable volume to become damaged. In order to avoid such an accident, a hinge cover C comprising a cover main body C1 and a movable cover member C2 fitted to the cover main body so as to pivot on pivot pin P is fitted typically to the movable intermediary arm 5 so that the space Si and the hazardous space S2 may be hidden by the cover main body C1.

Then, as the member plate B is swung open along arrow OP from the position in FIG. 14 to the position in FIG. 15, the movable cover member C2 is driven to rotate and extend from the cover main body C1 because the front end of flexible link belt C3 extending from the movable cover member C2 is fitted at the front end thereof to the movable front arm 6. As a result, the growing hazardous space S2 is hidden by the movable cover member C2.

However, since the distance by which the movable cover member C2 can extend from the cover main body C1 is limited by the dimensions of the latter, the hazardous space S2 can become exposed to a considerable extent when the movable plate B is moved to its open position as shown in FIG. 15. Additionally, when the movable plate B is opened by 90 degrees relative to the fixed plate A as shown in FIG. 16, the hazardous space S2 is mostly exposed although its size is reduced slightly.

SUMMARY OF THE INVENTION

With the known technology of using a hinge cover C, the cover C can hide space S1 satisfactorily but cannot satisfactorily cover hazardous space S2 although the hinge cover C are dimensioned to be considerably large in an attempt to completely cover the hinge.

Such a hinge cover C limits the space available for storing goods in the furniture and can obstruct the operation of taking out an article from and putting it back into the furniture, although the hinge cover C is rather costly.

In view of the above identified problem of the known technology, it is a first object of the present invention to provide a hinge with a safety shield plate unit designed not to cover the hinge but to be rotatably fitted to the fixed front shaft of the hinge and resiliently urged toward the cup-shaped fixing member of the hinge by means of a resilient member in such a way that said safety shield plate unit is prevented from unnecessarily moving toward the cup-shaped fixing member by causing the anchoring sections of the movable link arm to abut the respective anchored sections of the safety shield plate unit.

With such an arrangement, when the movable plate will be swung open from or closed relative to the fixed plate, the safety shield plate unit is reliably rotated in order to hide the hazardous space and prevent any unexpected accident from happening. Additionally, such a safety shield plate unit will not be expensive but will be sized relatively small so that it will not reduce the available space of the furniture to which it is fitted. Still additionally, the free end of the safety shield plate unit will be prevented from unduly entering the cup-shaped space of the cup-shaped fixing member to obstruct a smooth opening or closing motion of the movable member.

Preferably, the above resilient member for resiliently urging said safety shield plate unit toward said cup-shaped fixing member is arranged between the resilient member receiving section of the safety shield plate unit and the engaging hole of the movable link arm in order to make the safety shield plate unit operate reliably.

Preferably, the safety shield plate unit is prevented from moving unintentionally in order to make it operate reliably to cover the hazardous space by allowing the anchoring projections arranged at the opposite lateral sides of the movable link arm to freely abut the receiving end of the space within the safety shield plate unit so as to improve the relationship between the anchoring sections and the anchored sections.

Preferably, the resilient member is not a coil spring but a helical spring held in engagement with the fixed front shaft and having its opposite ends held respectively to the resilient member receiving section and the fixing member. Alternatively, the helical spring may be held in engagement with a lateral shaft arranged on the fixing member at a position close to the fixed plate and having one end thereof held to the base section of the safety shield plate unit and the other end held to the fixing member.

A second object of the present invention is to provide a hinge with a safety shield plate unit that is different from the above described hinge for achieving the first object in that the safety shield plate unit is prevented from moving unintentionally not by the freely abutting arrangement of the anchoring sections and the anchored sections but by making the safety shield plate unit larger in size so that it may not enter the cup-shaped space of the cup-shaped fixing member to make the hinge inoperative by the constant urging effort of the resilient member and additionally it may be prevented from entering the cup-shaped space by collision of the exposed area of the cup-shaped fixing member and the movable plate. Then, while the safety shield plate unit may be sized slightly greater than its counterpart that is designed for achieving the first object, it does not require the anchoring sections nor the anchored sections to make the unit structurally simple and provide a reliable effect of hiding the hazardous space.

Preferably, the resilient member is not a coil spring but a helical spring held in engagement with the fixed front shaft and having its opposite ends held respectively to the resilient member receiving section and the fixing member. Alternatively, the helical spring may be held in engagement with a lateral shaft arranged on the fixing member at a position close to the fixed plate and having one end thereof held to the base section of the safety shield plate unit and the other end held to the fixing member.

According to a first aspect of the invention, the above first object is achieved by providing a hinge with a safety shield plate unit comprising a fixing member to be fitted to a fixed plate of a piece of furniture, a cup-shaped fixing member fitted to and held in engagement with a movable plate of the furniture and a movable link arm and a movable rear arm respectively rotatably fitted to a fixed front shaft and a fixed rear shaft, said movable rear arm being adapted to pivot at the (intermediary) rear end thereof on an (intermediary) rear shaft, said movable intermediary arm being adapted to pivot at the (intermediary) front end thereof on an intermediary cup-side shaft in the inside of the cup-shaped space of said cup-shaped fixing member, said movable link arm and said movable intermediary arm being linked at middle sections thereof by an intermediary shaft, said linking front shaft at the linking front end of said movable link arm and a front cup-side shaft arranged within said cup-shaped space of said cup-shaped fixing member being linked by a movable front arm so as to allow said movable plate to be swung open and closed relative to said fixed plate, characterized in that said safety shield plate unit having its base section held to said front fixing shaft is so arranged as to be rotatable in the gap between said movable intermediary arm and said movable link arm and resiliently urged toward the cup-shaped fixing member by a resilient member, while the anchored sections of said safety shield plate unit abut the respective anchoring sections of said movable link arm to limit the entrance of said safety shield plate unit into the cup-shaped space of said cup-shaped fixing member so that the hazardous space defined by the movable link arm, the movable front arm and the intermediary arm of the cup-shaped fixing member and having a variable volume is hidden to make it nonhazardous when the movable plate is made to swing open and closed relative to the fixed plate.

Preferably, said safety shield plate unit includes a pair of oppositely disposed shield plates projecting respectively from a pair of base sections and arranged in the respective gaps located at the lateral ends of the movable intermediary arm and the movable link arm and separated from each other and a resilient member receiving section formed by coupling said pair of shield plates at a position close to the base sections of said pair of shield plates entering the cup-shaped space when the hinge is moved to its closed position, a coil spring being arranged as resilient member between said resilient member receiving section and an engaging hole formed in the movable link arm at a position close to the fixed front shaft.

Preferably, said safety shield plate unit includes a pair of oppositely disposed shield plates projecting respectively from a pair of base sections and arranged in the respective gaps located at the lateral ends of the movable intermediary arm and the movable link arm and separated from each other and the anchoring sections of the movable link arm is formed by anchoring projections projecting from the lateral opposite ends of the movable link arm, while the anchored sections of the safety shield plate unit are formed by receiving edges of the cavities formed in the shield plates to allow said anchoring projections to respectively pass therethrough.

Preferably, said safety shield plate unit includes a pair of oppositely disposed shield plates projecting respectively from a pair of base sections and arranged in the respective gaps located at the lateral ends of the movable intermediary arm and the movable link arm and separated from each other and a resilient member receiving section formed by coupling said pair of shield plates at a position close to the base sections of said pair of shield plates entering the cup-shaped space when the hinge is moved to its closed position, a helical spring being engaged as resilient member with the fixed front shaft with an end thereof held to said resilient member receiving section and the other end thereof held to the fixing member.

Preferably, said safety shield plate unit includes a pair of oppositely disposed shield plates projecting respectively from a pair of base sections and arranged in the respective gaps located at the lateral ends of the movable intermediary arm and the movable link arm and separated from each other and a resilient member receiving section formed by coupling said pair of shield plates at a position close to the base sections of said pair of shield plates entering the cup-shaped space when the hinge is moved to its closed position, a helical spring being engaged as resilient member with a pivoting shaft arranged laterally in the fixing member at a position close to the fixed plate with an end thereof held to the base sections of said safety shield plate unit and the other end thereof held to the fixing member.

According to a second aspect of the invention, the above second object is achieved by providing a hinge with a safety shield plate unit comprising a fixing member to be fitted to a fixed plate of a piece of furniture, a cup-shaped fixing member fitted to and held in engagement with a movable plate of the furniture and a movable link arm and a movable rear arm respectively rotatably fitted to a fixed front shaft and a fixed rear shaft, said movable rear arm being adapted to pivot at the (intermediary) rear end of a movable intermediary arm on an (intermediary) rear shaft, said movable intermediary arm being adapted to pivot at the (intermediary) front end thereof on an intermediary cup-side shaft in the inside of the cup-shaped space of said cup-shaped fixing member, said movable link arm and said movable intermediary arm being linked at middle sections thereof by an intermediary shaft, said linking front shaft at the linking front end of said movable link arm and a front cup-side shaft arranged within said cup-shaped space of said cup-shaped fixing member being linked by a movable front arm so as to allow said movable plate to be swung open and closed relative to said fixed plate, characterized in that said safety shield plate unit having its base section held to said front fixing shaft is so arranged as to be rotatable in the gap between said movable intermediary arm and said movable link arm and resiliently urged toward the cup-shaped fixing member by a resilient member so that the hazardous space defined by the movable link arm, the movable front arm and the intermediary arm of the cup-shaped fixing member and having a variable volume is hidden to make it non-hazardous when the movable plate is made to swing open and closed relative to the fixed plate while the free end of the safety shield plate unit is so dimensioned as to make it prevented from falling into the cup-shaped space of the cup-shaped fixing member from the outer edge side thereof in order to restrict the movement of the free end entering the cup-shaped space of said cup-shaped fixing member.

Preferably, said safety shield plate unit includes a pair of oppositely disposed shield plates projecting respectively from a pair of base sections and arranged in the respective gaps located at the lateral ends of the movable intermediary arm and the movable link arm and separated from each other and a resilient member receiving section formed by coupling said pair of shield plates at a position close to the base sections of said pair of shield plates entering the cup-shaped space when the hinge is moved to its closed position, a helical spring being engaged as resilient member with the fixed front shaft with an end thereof held to said resilient member receiving section and the other end thereof held to the fixing member.

Preferably, said safety shield plate unit includes a pair of oppositely disposed shield plates projecting respectively from a pair of base sections and arranged in the respective gaps located at the lateral ends of the movable intermediary arm and the movable link arm and separated from each other and a resilient member receiving section formed by coupling said pair of shield plates at a position close to the base sections of said pair of shield plates entering the cup-shaped space when the hinge is moved to its closed position, a helical spring being engaged as resilient member with a pivoting shaft arranged laterally in the fixing member at a position close to the fixed plate with an end thereof held to the base sections of said safety shield plate unit and the other end thereof held to the fixing member.

BRIEF DESCRIPTION OF THE DRAWINGS

FIGS. 1A and 1B are schematic illustrations of an embodiment of a hinge with a safety shield plate unit according to the first aspect of the invention, of which FIG. 1A is a partly cut away schematic plan view and FIG. 1B is a schematic lateral view as viewed from above in FIG. 1A.

FIGS. 5A and 5B are schematic illustrations of an area of the hinge of FIG. 4, showing an area close to the fixed front shaft of FIG. 4, of which FIG. 5A is a schematic bottom view and FIG. 5B is a schematic cross-sectional view taken along line B—B in FIG. 5A.

DESCRIPTION OF THE PREFERRED EMBODIMENTS OF THE INVENTION

Figure 1A:
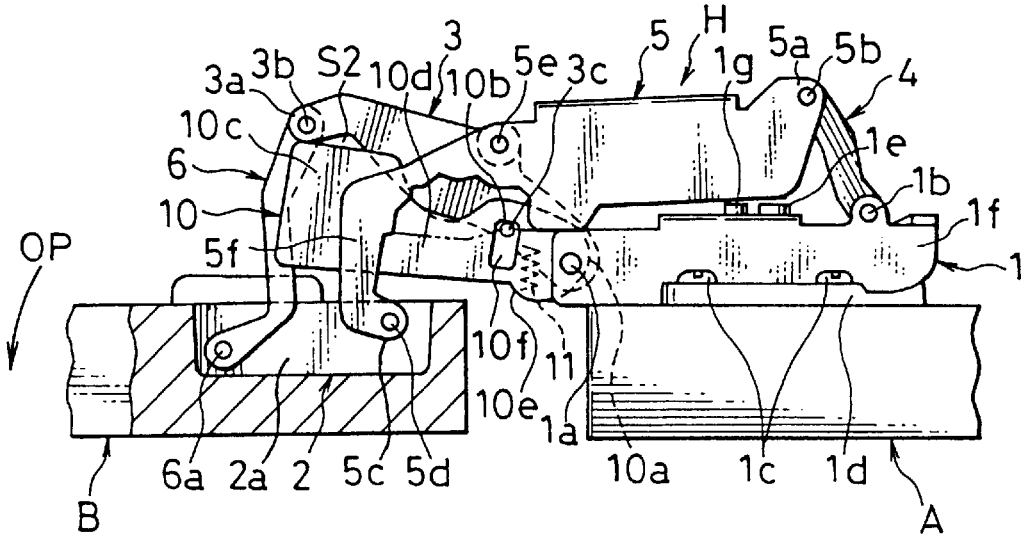

Now, the present invention will be described by referring to the accompanying drawings that illustrate preferred embodiments of the invention.

FIGS. 1 through 5 schematically illustrate preferred embodiments according to the first aspect of the invention. Referring to FIGS. 1 through 5, hinge main body H is used to link a fixed plate A and a movable plate B and has a configuration substantially identical with that of the known hinge illustrated in FIGS. 14 through 16. Therefore, the components which are the same as the counterparts of the known hinge are denoted respectively by the same reference symbols and will not be described any further unless some additional description is deemed to be necessary.

The hinge comprises a fixing member 1, a cup-shaped fixing member 2, a movable link arm 3 for linking the fixing member 1 and the cup-shaped fixing member 2, a movable rear arm 4, a movable intermediary arm 5 and a movable front arm 6, which are rotatably linked together by means of a fixed front shaft 1*a*, a fixed rear shaft 1*b*, a linking front shaft 3*b*, an (intermediary) rear shaft 5*b*, an intermediary cup-side shaft 5*d*, an intermediary shaft 5*e* and a front cup-side shaft 6*a*.

Figure 1B:
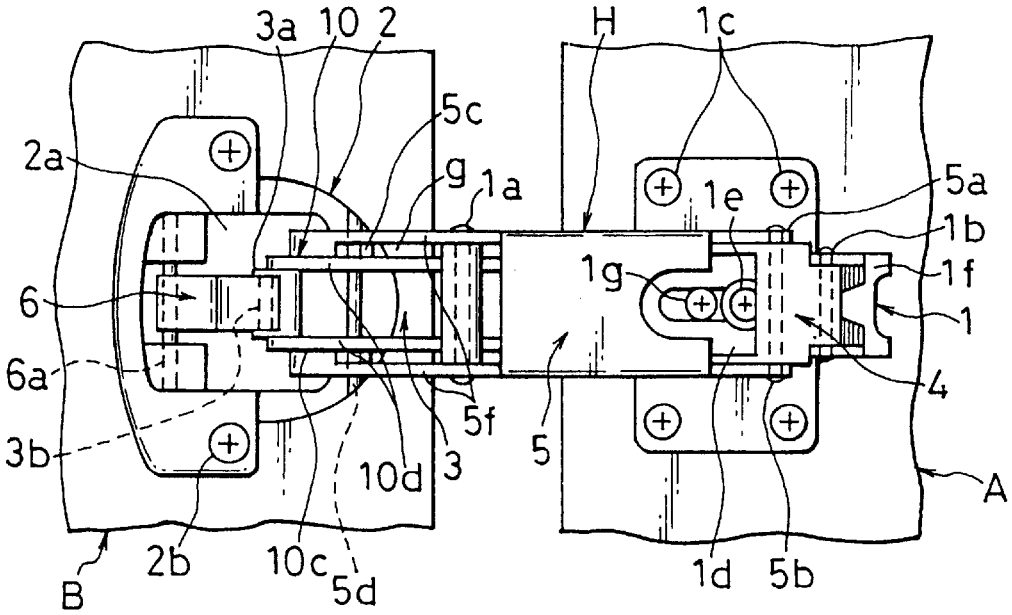

Referring to FIGS. 1A and 1B, the fixing member 1 comprises a mounting plate 1*d* to be secured to the fixed plate A by means of screws 1*c* and a fixed frame 1*f* to be secured to the mounting plate 1*d* by means of an anchor bolt 1*e*. In FIGS. 1A and 1B, reference symbol 1*g* denotes an adjuster screw for laterally adjusting the position of the movable plate B. In FIG. 1B, reference symbol 2*b* denotes screws for securing the cup-shaped fixing member 2 to the movable plate B and reference symbol S2 denotes the hazardous space defined by the movable link arm 3, the movable front arm 6, the cup-shaped fixing member 2 and the movable intermediary arm 5 as described earlier.

As seen also from FIG. 1B, the movable intermediary arm 5 is formed by bifurcated intermediary plate sections 5*f* at the side of the cup-shaped fixing member 2 and the movable link arm 3 and the movable front arm 6 are arranged at a lateral middle area thereof.

Figure 2:
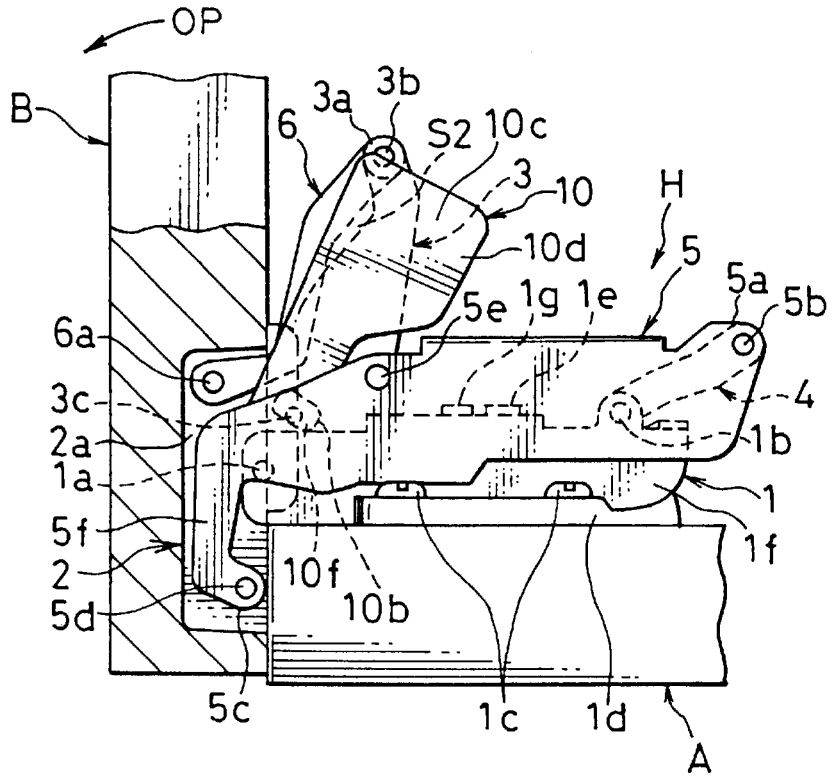
FIG. 2 is a partly cut away schematic plan view of the hinge of FIG. 1A in a closed position.

In the hinge main body H according to the invention and having the above described configuration, a safety shield plate unit 10 having its base sections 10*s* rotatably fitted to the fixed front shaft 1*a* is rotatably arranged in the gaps between the intermediary lateral wall sections 5*f* of the movable intermediary arm 5 and the movable link arm 3 as shown in FIG. 2.

Then, there is provided a resilient member 11 that is typically a spring or a rubber member for resiliently and constantly urging the safety shield plate unit 10 toward the safety shield plate unit 2 in order to prevent the safety shield plate unit 10 from swinging freely and push it toward the movable plate B.

What is vitally important with the hinge according to the invention is that said safety shield plate unit 10 cannot move freely to abuts the cup-shaped fixing member 2 and/or some other members if it is resiliently urged by the resilient member 11. To the contrary, its rotary motion is limited in a manner as discussed below.

Once the anchored sections 10*b* of the safety shield plate unit 10 are held by the respective anchoring sections 3*c* of the movable link arm 3, any movement of the safety shield plate unit 10 trying to enter the cup-shaped space 2*a* of the cup-shaped fixing member 2 is limited so that, when the movable plate B is swung open or closed relative to the fixed plate A, the free end 10*c* of the safety shield plate unit 10 is prevented from entering the cup-shaped space 2*a* and obstructing the movement of the door to its closed or open position and the proper function of the hinge main body H is always guaranteed.

With the above described embodiment, the hazardous space S2 that is defined by the movable link arm 3, the movable front arm 6, the cup-shaped fixing member 2 and the movable intermediary arm 5 and catch the operating finger or part of the clothes of the user is constantly hidden by the free end 10*c* of the safety shield plate unit 10 to render the hazardous space S2 whose volume is variable when the movable plate B is made to swing open or closed relative to the fixed plate A totally nonhazardous.

Figure 5A:
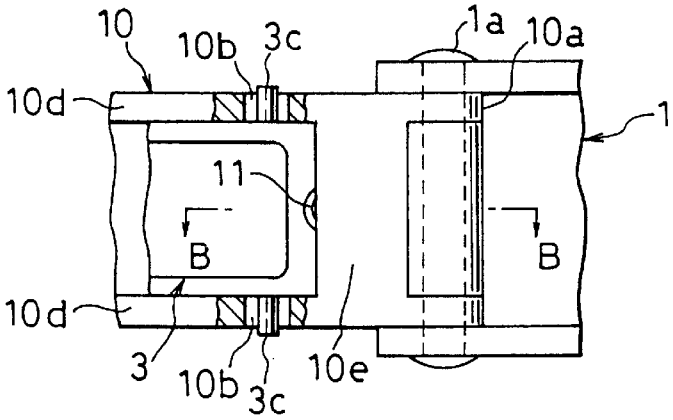
Figure 5B:
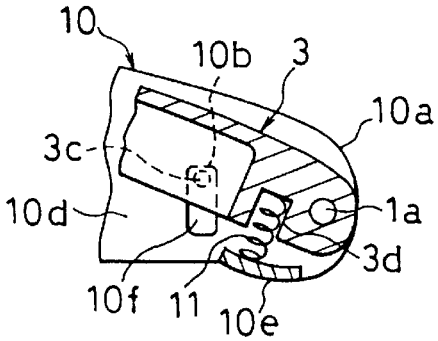

FIG. 5 shows a preferably configuration of the resilient member 11 of the above embodiment.

Referring to FIG. 5, the safety shield plate unit 10 includes a pair of oppositely disposed shield plates 10*d* projecting respectively from a pair of base sections 10*a* and arranged in the respective gaps g (see FIG. 1B) located at the lateral ends of the intermediary plate sections 5*f* of the movable intermediary arm 5 and the movable link arm 3 and separated from each other and a resilient member receiving section 10*e* is formed by uniting the shield plates 10*d* at a position close to the base sections 10*a* adapted to enter the cup-shaped space 2*a* when the hinge is held to its closed position as shown in FIG. 2.

Then, a coil spring is arranged as resilient member 11 between said resilient member receiving section 10*e* and an engaging hole 3*d* formed in the movable link arm 3 at a position close to the fixed front shaft 1*a* so that the safety shield plate unit 10 may be resiliently urged toward the movable plate B.

Preferably, the anchoring sections 3*c* of the movable link arm 3 is formed by anchoring projecting from the lateral opposite ends of the movable link arm 3, while the anchored sections 10*b* of the safety shield plate unit 10 are formed by receiving edges of the cavities 10*f* formed through the shield plates 10*d* to allow said anchoring projections to respectively pass therethrough at the side of the intermediary shaft 5*e*.

Figure 6:
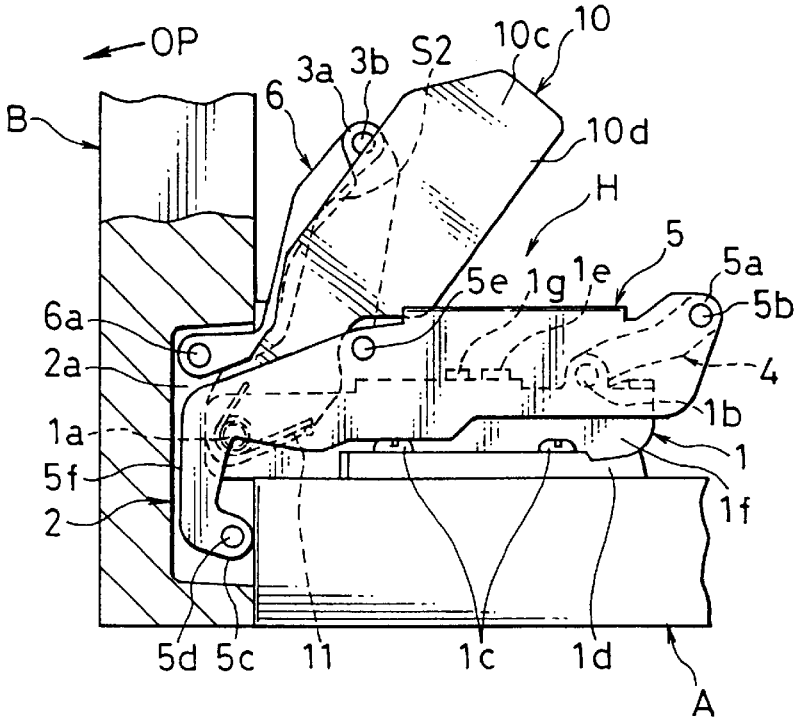
FIG. 6 is a partly cut away schematic plan view of the hinge of FIG. 4, where the door is closed.

Preferably, not a coil spring but a helical spring is engaged as resilient member 11 with the fixed front shaft 1*a* as shown in FIG. 6. Then, an end of the helical spring is held to said resilient member receiving section 10*e* for mutual abutment and the other end thereof is held to the fixing member 1 to make the overall configuration further simple.

Alternatively, a helical spring is engaged as resilient member 11 with pivoting shaft 11*a* arranged laterally in the fixing member 1 at a position close to the fixed plate A as shown in FIGS. 10 through 13. Then, an end of the helical spring is held to the base sections 10*a* of said safety shield plate unit 10 and the other end thereof is held to the fixing member 1 to make the overall configuration also further simple.

With a hinge having a configuration as described above, the volume of the hazardous space S2 is minimal when the movable member B is closed relative to the fixed plate A as shown in FIG. 2 so that there will be no danger of physical damage, although the safety shield plate unit 10 is nevertheless hiding the hazardous space S2. Under this condition, the safety shield plate unit 10 is pushed by the cup-shaped fixing member 2 so that the anchoring sections 3*c* are located in the respective cavities 10*f* of the safety shield plate unit 10 and separated from the respective anchored sections 10*b*, the resilient member 11 being compressed by the safety shield plate unit 10.

Figure 3:
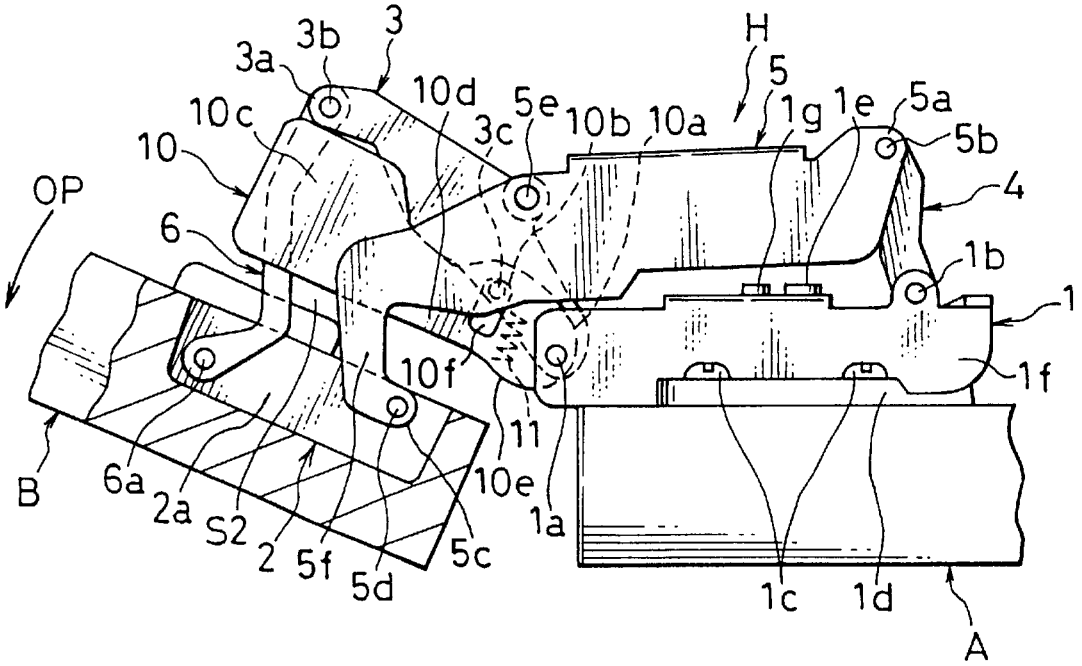
FIG. 3 is a partly cut away schematic plan view of the hinge of FIG. 1A in an open position, where the door is opened by an angle less than 90 degrees.

As the movable plate B is moved in the direction of arrow OP to open the plate, the hazardous space gradually increases its volume as seen from FIG. 3, although the safety shield plate unit 10 that is resiliently urged by the resilient member 11 follows the movable plate B to hide the hazardous space S2 and make it nonhazardous if it is partly or entirely exposed. Since the anchoring sections 3*c* hold the respective anchored sections 10*b* under this condition, the safety shield plate unit 10 cannot move toward the cup-shaped fixing member 2 so that the free end 10*c* is prevented from falling into the cup-shaped space 2*a* and being held there to make the hinge unable to be opened.

Figure 4:
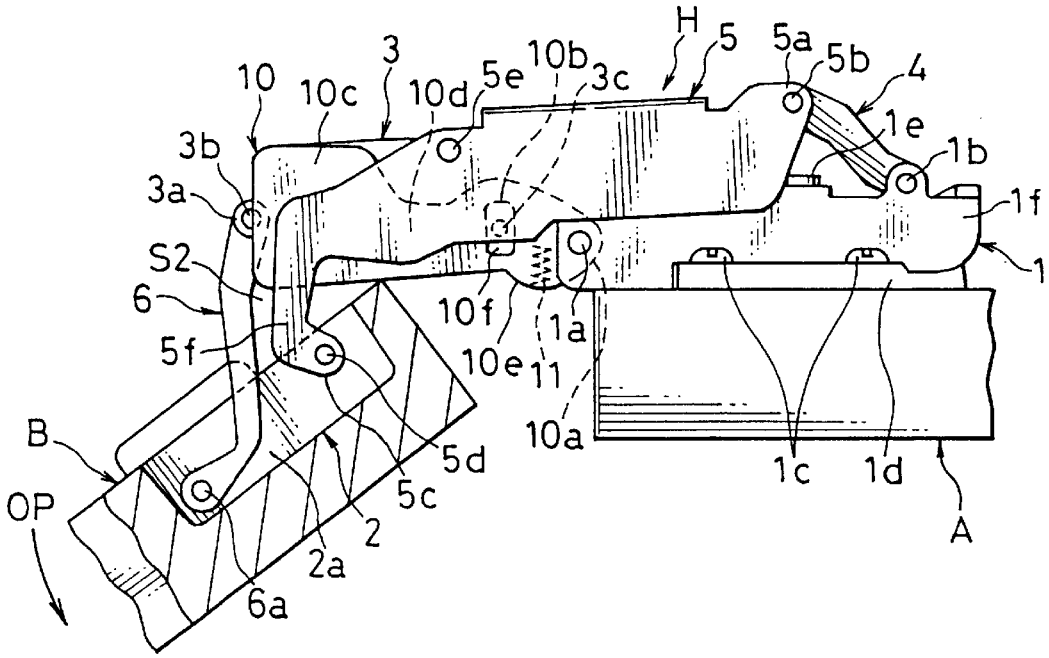
FIG. 4 is a partly cut away schematic plan view of the hinge of FIG. 1A in an open position, where the door is opened by an angle more than 90 degrees.

As the movable plate is swung open further to take a position as shown in FIG. 1A, the safety shield plate unit 10 keeps on satisfactorily hiding the hazardous space S2. When the movable plate B gets to the open position as shown in FIG. 4, the volume of the hazardous space S2 is reduced to make itself safe without a shield plate. Thus, although the movable plate B can be opened further, the hazardous space S2 will no longer be existent.

At the position of FIG. 4, the anchoring sections 3*c* drive the respective cavities 10*f* downward and, when the movable plate B is opened to show a possible maximum angle relative to the fixed plate A, the cavities 10*f* are made to get to the lowest level by the respective anchoring sections 3*c*, while the resilient member 11 is compressed further as the movable plate B is driven to become open.

Now, an embodiment according to the second aspect of the invention will be described by referring to FIGS. 6 through 9. The hinge main body of this embodiment has a configuration same as that of any of the above described embodiments according to the first aspect of the invention and the safety shield plate unit 10 having its base sections 10*a* rotatably fitted to the fixed front shaft 1*a* is made rotatable in the gaps g between the movable intermediary arm 5 and the movable link arm 3, while the safety shield plate unit 10 is resiliently urged toward the cup-shaped fixing member 2 by means of a resilient member 11.

Then, the hazardous space S2 is hidden by the free end 10*c* of the safety shield plate unit 10 to make it nonhazardous when the movable plate B is swung open or closed relative to the fixed plate A, while the free end 10*c* of the safety shield plate unit 10 is so dimensioned as to make it prevented from falling into the cup-shaped space 2*a* of the cup-shaped fixing member 2 from the outer edge side thereof in order to restrict the movement of the free end 10*c* entering the cup-shaped space 2*a* of said cup-shaped fixing member 2 so that consequently, the free end 10*c* extends by a length that prevents it from falling into the cup-shaped space 2*a* from the outer edge side (left side in FIGS. 6 through 9) of the cup-shaped fixing member 2.

Preferably, a helical spring is engaged as resilient member 11 with the fixed front shaft 1*a* with an end thereof held to the resilient member receiving section 10*e* of the safety shield plate unit 10 and the other end thereof held to an anchoring pin of the fixing member 1.

With a hinge having a configuration as described above, the safety shield plate unit 10 is located at a position where it hides the hazardous space S2, which is rather small as described above by referring to FIG. 2, when the movable plate B is closed relative to the fixed plate A, so that, although the resilient member 11 urges the cup-shaped fixing member 2, the movable plate B is held to is closed position and the free end 10*c* is extended from the linking front shaft 3*b* to a level considerably higher than that of FIG. 2.

Figure 7:
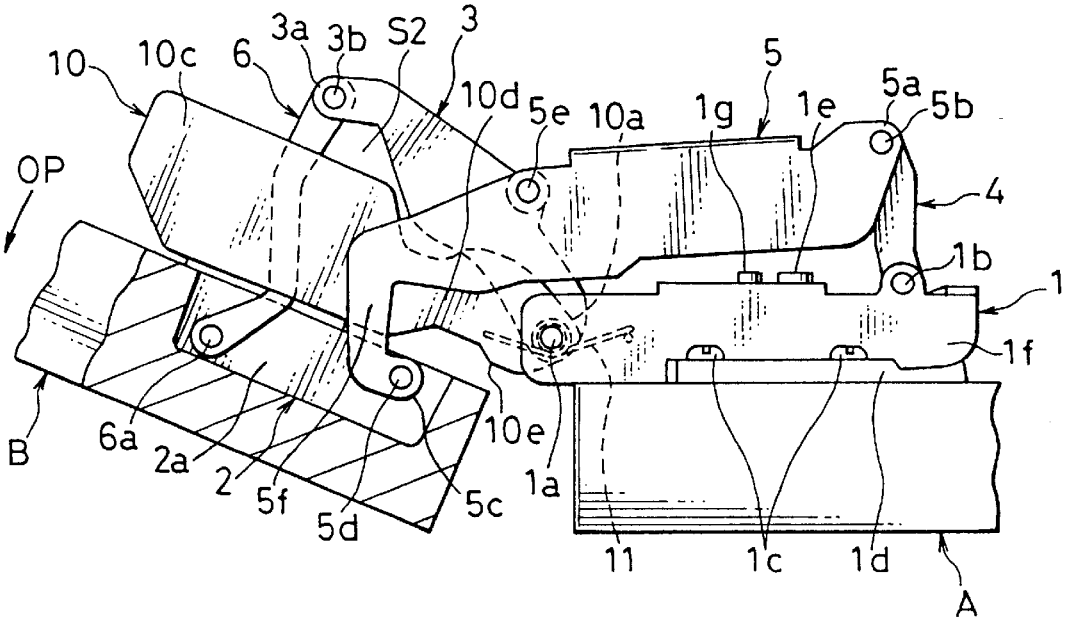
FIG. 7 is a partly cut away schematic plan view of the hinge of FIG. 4 in an open position, where the door is opened by an angle less than 90 degrees.

Then, as the movable plate B is driven to swing open in the direction of arrow OP, the hazardous space S2 is expanded as in the case of FIG. 3, although it is hidden by the safety shield plate unit 10 rotating under the effect of the resilient member 11 as shown in FIG. 7 to make the hazardous space S2 nonhazardous. Additionally, since the safety shield plate unit 10 of this embodiment is dimensioned so as not to fall into the cup-shaped space 2*a* in the course of the rotation motion of the movable plate B, the hinge is made to operate smoothly without making the anchored sections 10*b* to be held by the anchoring sections 3*c* as in the case of FIG. 3.

Figure 8:
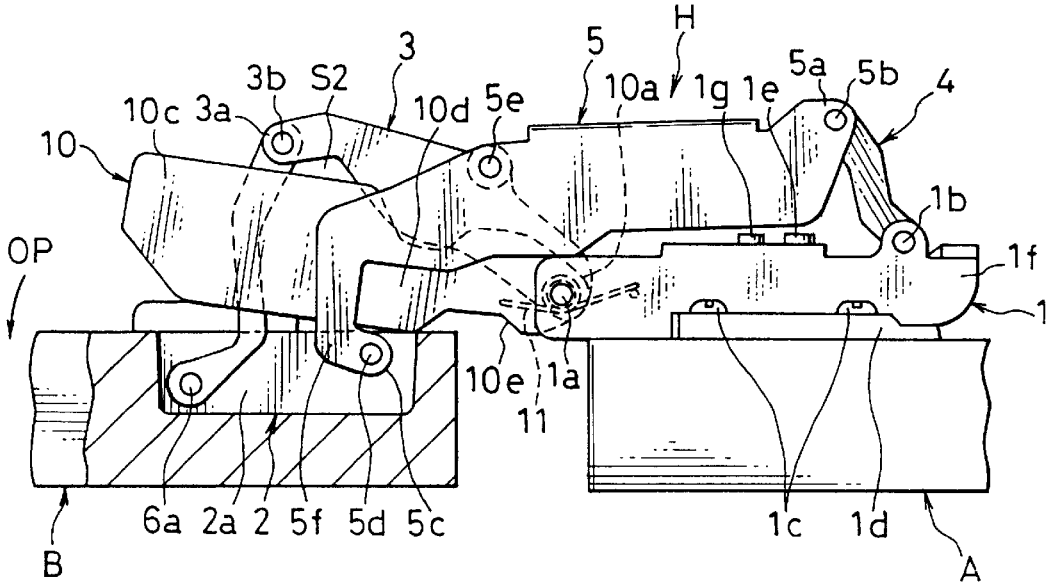
FIG. 8 is a partly cut away schematic plan view of the hinge of FIG. 4 in an open position, where the door is opened by an angle of 90 degrees.
Figure 9:
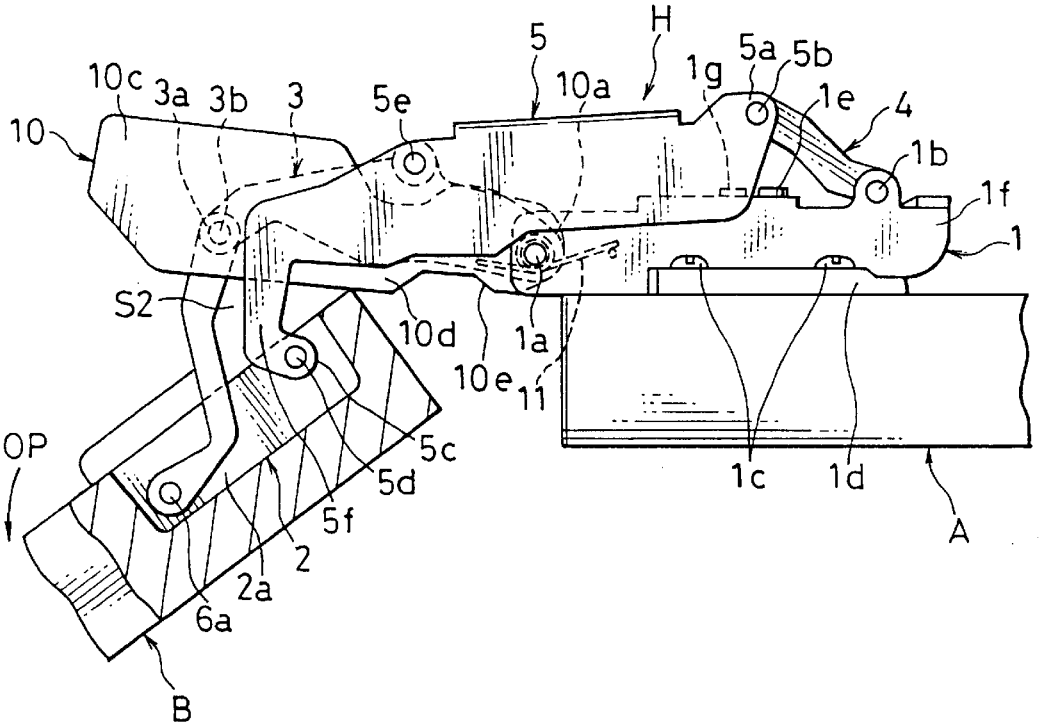
FIG. 9 is a partly cut away schematic plan view of the hinge of FIG. 4 in an open position, where the door is opened by an angle more than 90 degrees.
Figure 10:
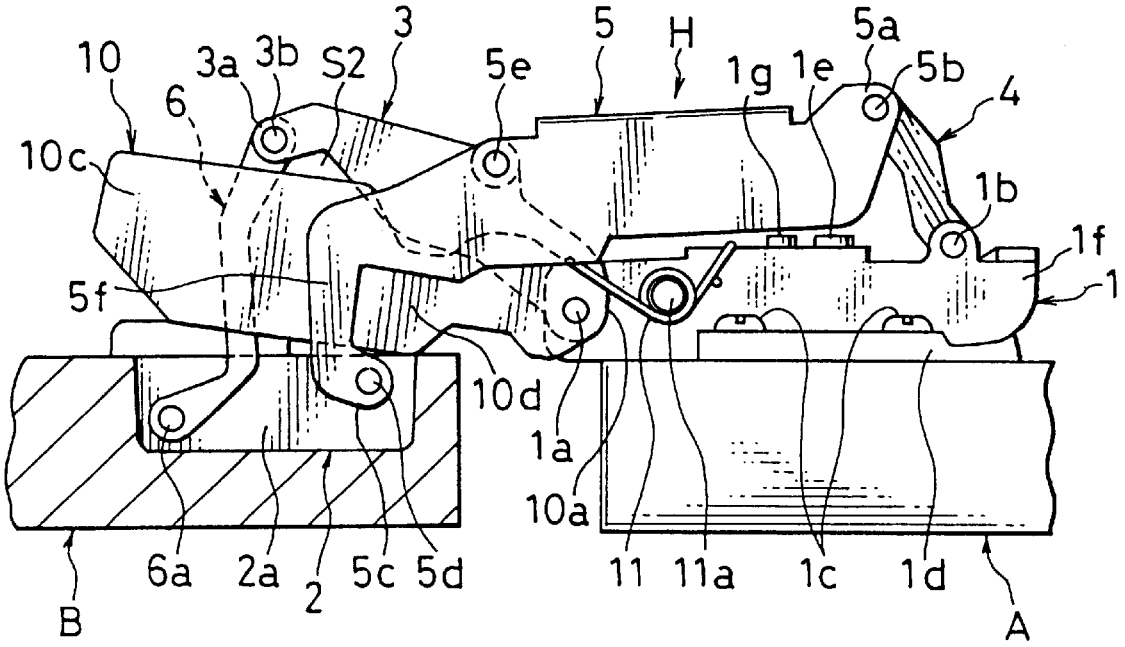
FIG. 10 is a partly cut away schematic plan view of the hinge of FIG. 4, where the door is closed and located at a position different from that of FIG. 6.
Figure 11:
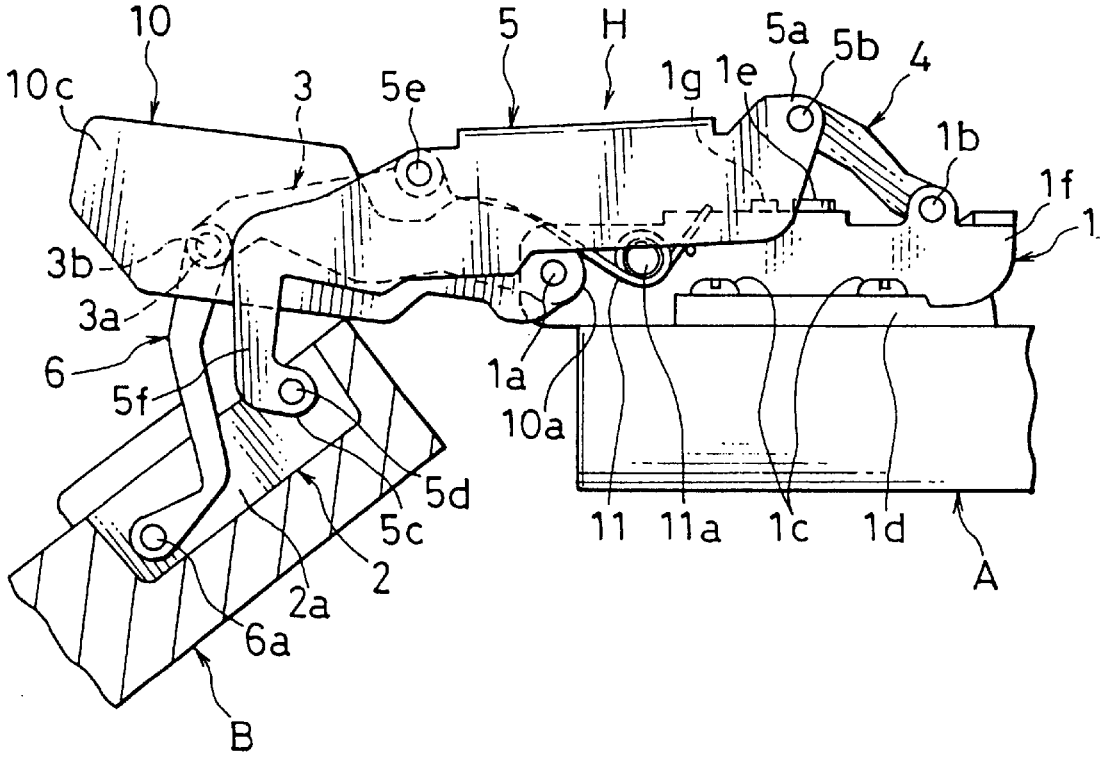
FIG. 11 is a partly cut away schematic plan view of the hinge of FIG. 10 in an open position, where the door is opened by an angle less than 90 degrees.
Figure 12:
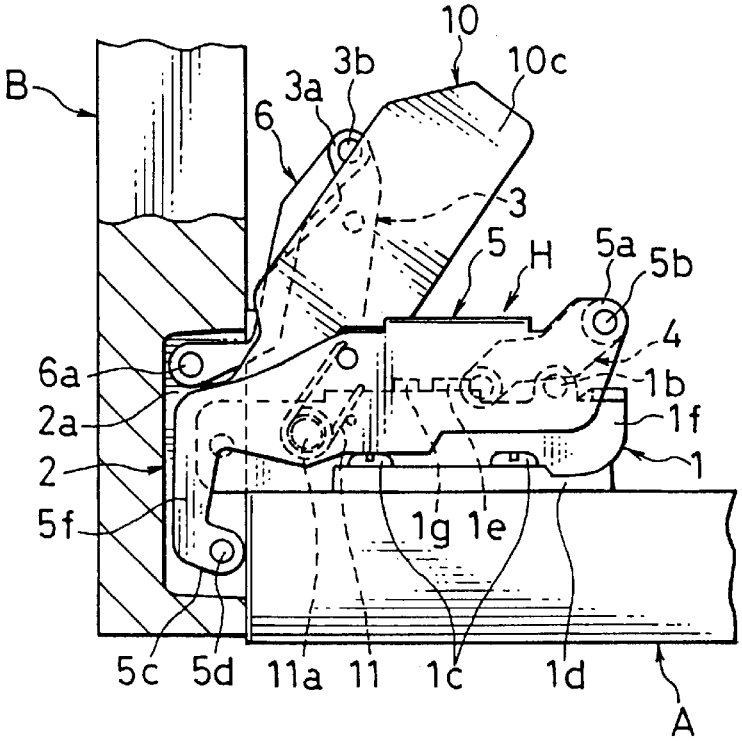
FIG. 12 is a partly cut away schematic plan view of the hinge of FIG. 10 in an open position, where the door is opened by an angle of 90 degrees.
Figure 13:
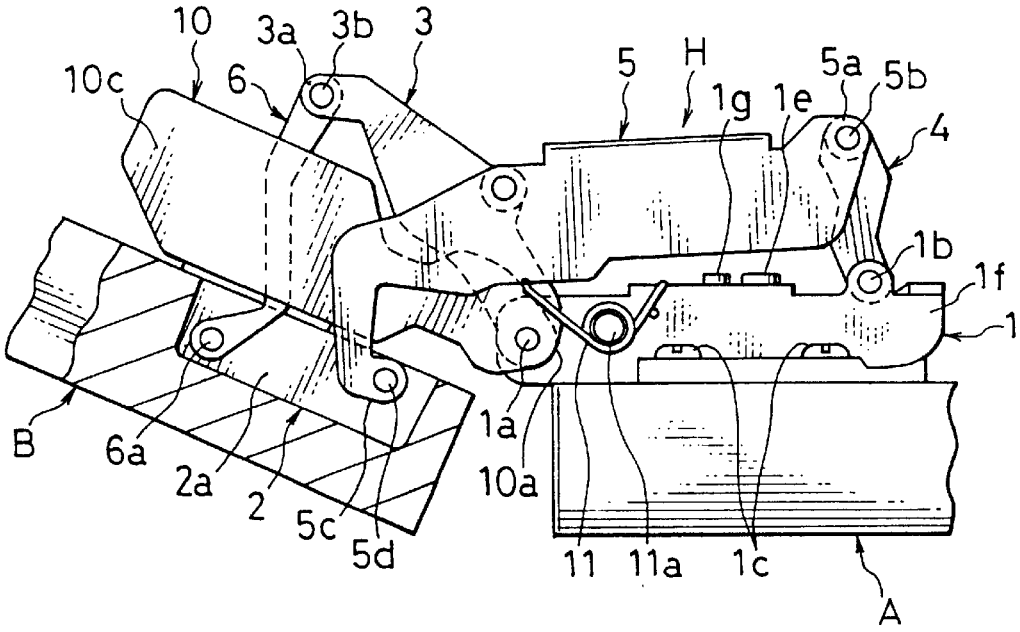
FIG. 13 is a partly cut away schematic plan view of the hinge of FIG. 10 in an open position, where the door is opened by an angle more than 90 degrees.

As the movable plate B is driven to rotate further, the hazardous space S2 is hidden and, at the same time, the safety shield plate unit 10 abuts the inner edge side of the cup-shaped fixing member 2 at the position close to the base sections 20*a* to prevents the free end thereof from falling into the cup-shaped space 2*a* as shown in FIG. 8. As the movable plate B is driven to rotate further to get to the position shown in FIG. 9, the volume of the hazardous space S2 is reduced to make it nonhazardous. Thereafter, the volume of the hazardous space S2 is reduced further as the movable plate B is rotated still further.

Thus, if compared with a hinge according to the first aspect of the invention, a hinge according to the second aspect of the invention has a safety shield plate unit 10 larger than the former, although the latter does not require the use of anchoring sections 3*c* and the anchored sections 10*b* to make the overall configuration more simple. In other words, a hinge according to the first aspect of the invention has an advantage that a small safety shield plate unit 10 can be used in it to reduce the overall volume of the furniture main body.

Alternatively, according to the invention, the helical spring may be arranged in a manner as shown in FIGS. 13 through 16 that is different from the above described counterpart.

The safety shield plate unit 10 comprises a pair of oppositely disposed shield plates 10*d* that are extended from a pair of base sections 10*a* thereof and located in the respective gaps g at the lateral ends of the movable intermediary arm 5 and the movable link arm 3 as in the case of the above embodiment. Then, a helical spring is engaged as pivoting shaft 11 with pivoting shaft 11*a* arranged laterally in the fixing member 1 at a position close to the fixed plate A.

Then, an end of the helical spring is held to the base sections 10*a* of said safety shield plate unit 10 and the other end thereof is held to the fixing member 1 to make the overall configuration also further simple.

Figure 14:
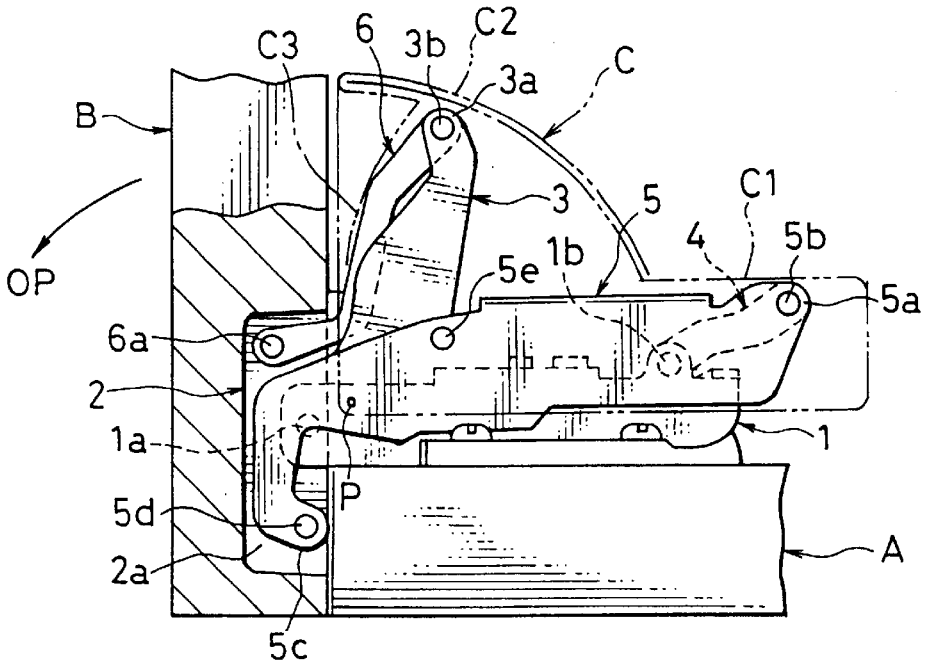
FIG. 14 (PRIOR ART)
FIG. 14 is a partly cut away schematic plan view of a known hinge of the type under consideration, where the door is closed.
Figure 15:
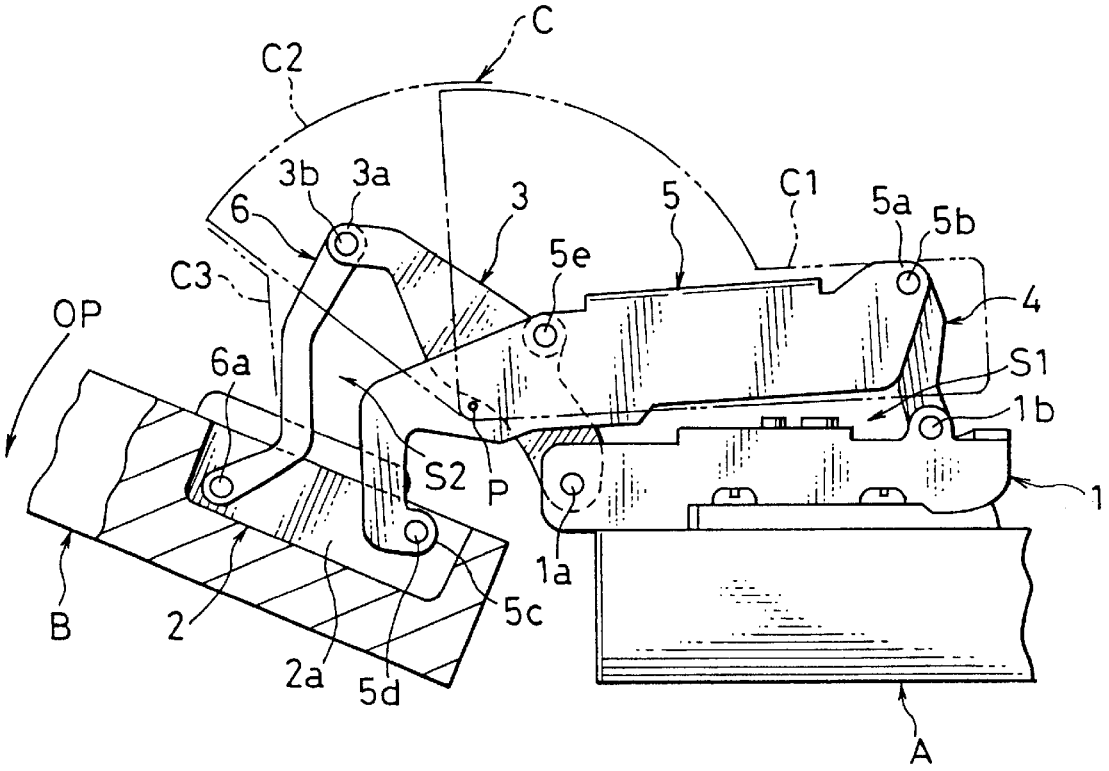
FIG. 15 (PRIOR ART)
FIG. 15 is a partly cut away schematic plan view of the hinge of FIG. 14 in an open position, where the door is opened by an angle less than 90 degrees.
Figure 16:
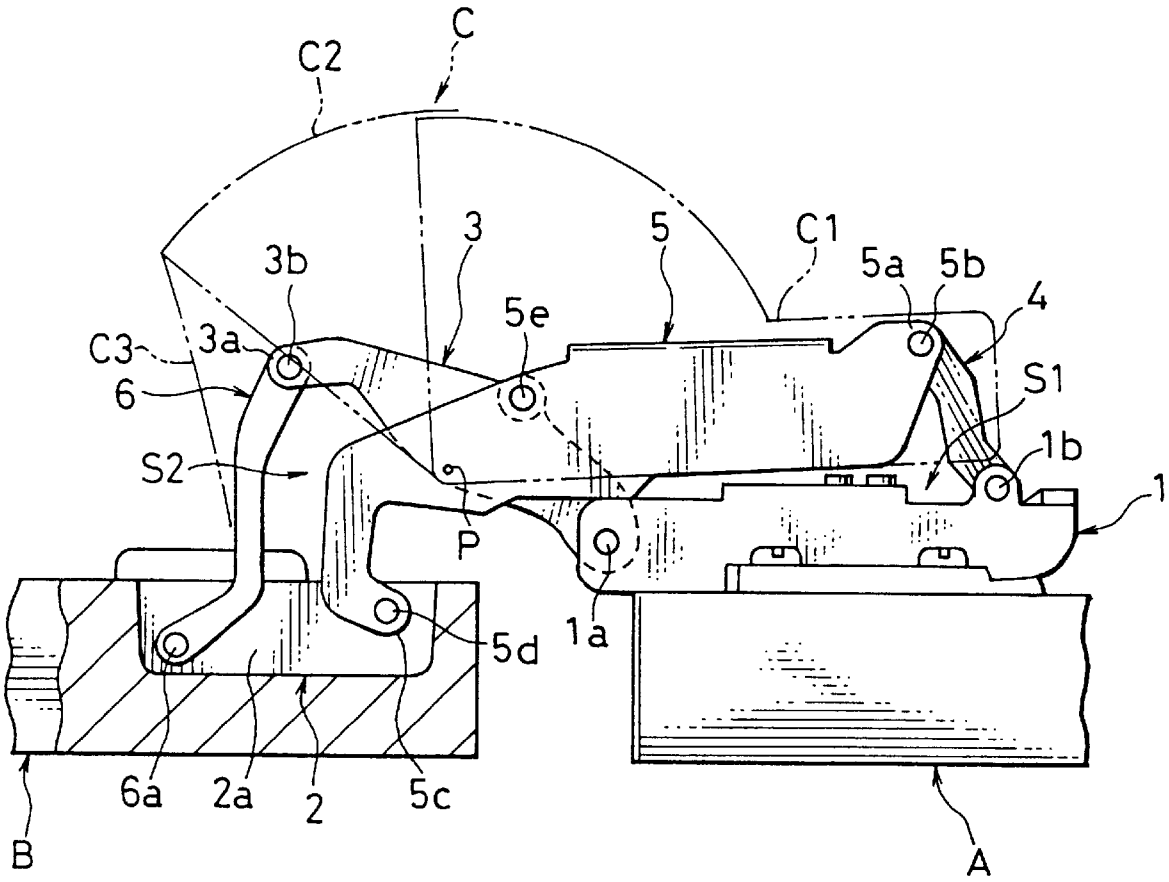
FIG. 16 (PRIOR ART)
FIG. 16 is a partly cut away schematic plan view of the hinge of FIG. 14 in an open position, where the door is opened by an angle of 90 degrees.

FIG. 14 is a partly cut away schematic plan view of a known hinge of the type under consideration, where the door is closed and FIG. 15 is a partly cut away schematic plan view of the hinge of FIG. 14 in an open position, where the door is opened by an angle less than 90 degrees, whereas FIG. 16 is a partly cut away schematic plan view of the hinge of FIG. 14 in an open position, where the door is opened by an angle of 90 degrees, said figures being drawn to make the above described arrangement of the invention easily understandable. Thus, the relationship between the deformation of the helical spring and the rotary position of the safety shield plate unit 10 may be clearly realized by referring to FIGS. 14 through 16.

Thus, with a hinge according to the first aspect of the invention, the safety shield plate unit does not significantly project from the hinge main body and hence occupies no extra space if compared with a comparable known hinge. Therefore, the capacity of the furniture main body can be fully utilized and the safety shield plate unit can be prepared at a cost lower than a hinge cover designed to entirely cover the hinge main body. Then, the hinge of the present invention has an appearance that can improve the value of the product and effectively hide the hazardous space more than ever. Particularly, it can effectively eliminate the risk of hazardous accidents such as a finger pinched by the members of the hinge.

If the safety shield plate unit is provided with anchoring sections and matching anchored sections, the overall size of the safety shield plate unit can be reduced because the free end of the safety shield plate unit is effectively prevented from falling into the cup-shaped space of the hinge by the resilient force of the resilient member. Additionally, the movement of the safety shield plate unit following the hazardous space can be guaranteed by properly positioning the resilient member.

When a coil spring is used for the resilient member, it can be removably engaged with the anchoring sections and the anchored sections. When, a helical spring is alternatively be used for the resilient member, it will be engaged with the fixed front shaft or a pivoting shaft with its opposite ends held by appropriate members in order to guarantee the advantage of present invention.

With a hinge according to the second aspect of the invention, the safety shield plate unit is made dimensionally slightly greater than that of the hinge according to the first aspect of the invention in order to prevent the safety shield plate unit from accidentally falling in the cup-shaped space of the hinge. Then, the advantage of the first aspect of the invention is guaranteed without arranging anchoring sections and anchored sections so that the hinge can enjoy a prolonged service life.

A coil spring or a helical spring may be used for the hinge according to the second aspect of the invention to achieve the above described effect.

What is claimed is:

1. A hinge for mounting on a piece of furniture comprising a fixing member for fitting to a fixed plate of the piece of furniture, a cup-shaped fixing member for fitting with and being held in engagement with a movable plate of the piece of furniture, and a movable link arm and a movable rear arm rotatably fitted to a fixed front shaft of said fixing member and a fixed rear shaft of said fixing member, respectively, a movable intermediary arm being adapted to pivot at a front end thereof on an intermediary cup-side shaft located inside of a cup-shaped space of said cup-shaped fixing member, said movable link arm and said movable intermediary arm being linked together by an intermediary shaft, a linking front shaft at a linking front end of said movable link arm and a front cup-side shaft arranged within said cup-shaped space of said cup-shaped fixing member being linked by a movable front arm so as to allow said cup-shaped fixing member to be swung open and closed relative to said fixing member, a safety shield plate unit having a base section held to said fixed front shaft of said fixing member so as to be rotatable in a gap located between said movable intermediary arm and said movable link arm and resiliently urged toward the cup-shaped fixing member by a resilient member, while anchored sections of said safety shield plate unit abut said movable link arm to limit entrance of said safety shield plate unit into the cup-shaped space of said cup-shaped fixing member so that a hazardous space defined by the movable link arm, the movable front arm and the movable intermediary arm is hidden to make it nonhazardous when the movable plate is made to swing open and closed relative to the fixed plate.

2. A hinge according to claim 1, wherein said safety shield plate unit includes a pair of oppositely disposed shield plates projecting respectively from a pair of base sections and arranged in respective gaps located at lateral ends of the movable intermediary arm and the movable link arm and separated from each other and a resilient member receiving section formed by coupling said pair of shield plates at a position close to the base sections of said pair of shield plates entering the cup-shaped space when the hinge is moved to a closed position, a coil spring being arranged as the resilient member between said resilient member receiving section and an engaging hole formed in the movable link arm at a position close to the fixed front shaft.

3. A hinge according to claim 1, wherein said safety shield plate unit includes a pair of oppositely disposed shield plates projecting respectively from a pair of base sections and arranged in respective gaps located at lateral ends of the movable intermediary arm and the movable link arm and separated from each other and anchoring sections of the movable link arm formed by anchoring projections projecting from lateral opposite ends of the movable link arm, while anchored sections of the safety shield plate unit are formed by receiving edges of cavities formed in the shield plates to allow said anchoring projections to respectively pass therethrough.

4. A hinge according to claim 1, wherein said safety shield plate unit includes a pair of oppositely disposed shield plates projecting respectively from a pair of base sections and arranged in respective gaps located at lateral ends of the movable intermediary arm and the movable link arm and separated from each other and a resilient member receiving section formed by coupling said pair of shield plates at a position close to the base sections of said pair of shield plates entering the cup-shaped space when the hinge is moved to a closed position, a helical spring being engaged as the resilient member with the fixed front shaft with an end thereof held to said resilient member receiving section and the other end thereof held to the fixing member.

5. A hinge according to claim 1, wherein said safety shield plate unit includes a pair of oppositely disposed shield plates projecting respectively from a pair of base sections and arranged in respective gaps located at lateral ends of the movable intermediary arm and the movable link arm and separated from each other and a resilient member receiving section formed by coupling said pair of shield plates at a position close to the base sections of said pair of shield plates entering the cup-shaped space when the hinge is moved to a closed position, a helical spring being engaged as the resilient member with a pivoting shaft arranged laterally in the fixing member at a position close to the fixed plate with an end thereof held to the base sections of said safety shield plate unit and the other end thereof held to the fixing member.

6. A hinge for mounting on a piece of furniture comprising a fixing member for fitting to a fixed plate of the piece of furniture, a cup-shaped fixing member for fitting with and being held in engagement with a movable plate of the piece of furniture, and a movable link arm and a movable rear arm rotatably fitted to a fixed front shaft of said fixing member and a fixed rear shaft of said fixing member, respectively, said movable rear arm being adapted to pivot on a movable intermediary arm on an intermediary rear shaft of said movable intermediary arm, said movable intermediary arm being adapted to pivot on an intermediary cup-side shaft located inside of a cup-shaped space of said cup-shaped fixing member, said movable link arm and said movable intermediary arm being linked together by an intermediary shaft, a linking front shaft at a linking front end of said movable link arm and a front cup-side shaft arranged within said cup-shaped space of said cup-shaped fixing member being linked by a movable front arm so as to allow said cup-shaped fixing member to be swung open and closed relative to said fixing member, a safety shield plate unit having a base section held to said fixed front shaft of said fixing member so as to be rotatable in a gap located between said movable intermediary arm and said movable link arm and resiliently urged toward the cup-shaped fixing member by a resilient member so that a hazardous space defined by the movable link arm, the movable front arm and the movable intermediary arm is hidden to make it non-hazardous when the movable plate is made to swing open and closed relative to the fixed plate while a free end of the safety shield plate unit is so dimensioned as to prevent the safety shield plate unit from falling into the cup-shaped space of the cup-shaped fixing member from an outer edge side thereof in order to restrict the movement of the safety shield plate unit entering the cup-shaped space of said cup-shaped fixing member.

7. A hinge according to claim 6, wherein said safety shield plate unit includes a pair of oppositely disposed shield plates projecting respectively from a pair of base sections and arranged in respective gaps located at lateral ends of the movable intermediary arm and the movable link arm and separated from each other and a resilient member receiving section formed by coupling said pair of shied plates at a position close to the base sections of said pair of shield plates entering the cup-shaped space when the hinge is moved to a closed position, a helical spring being engaged as the resilient member with the fixed front shaft with an end thereof held to said resilient member receiving section and the other end thereof held to the fixing member.

8. A hinge according to claim 6, wherein said safety shield plate unit includes a pair of oppositely disposed shield plates projecting respectively from a pair of base sections and arranged in respective gaps located at lateral ends of the movable intermediary arm and the movable link arm and separated from each other and a resilient member receiving section formed by coupling said pair of shield plates at a position close to the base sections of said pair of shield plates entering the cup-shaped space when the hinge is moved to a closed position, a helical spring being engaged as the resilient member with a pivoting shaft arranged laterally in the fixing member at a position close to the fixed plate with an end thereof held to the base sections of said safety shield plate unit and the other end thereof held to the fixing member.

* * * * *